US008658969B2

(12) United States Patent
Nishiguchi

(10) Patent No.: US 8,658,969 B2
(45) Date of Patent: Feb. 25, 2014

(54) MASS SPECTROMETER

(75) Inventor: Masaru Nishiguchi, Hirakata (JP)

(73) Assignee: Shimadzu Corporation, Kyoto-Shi (JP)

( * ) Notice: Subject to any disclaimer, the term of this patent is extended or adjusted under 35 U.S.C. 154(b) by 44 days.

(21) Appl. No.: 12/920,306

(22) PCT Filed: Mar. 5, 2008

(86) PCT No.: PCT/JP2008/000451

§ 371 (c)(1),
(2), (4) Date: Aug. 30, 2010

(87) PCT Pub. No.: WO2009/110025

PCT Pub. Date: Sep. 11, 2009

(65) Prior Publication Data

US 2011/0012017 A1 Jan. 20, 2011

(51) Int. Cl.
*H01J 49/00* (2006.01)

(52) U.S. Cl.
USPC ..... 250/281; 250/282; 250/290

(58) Field of Classification Search
USPC ..... 250/281, 282, 288, 290
See application file for complete search history.

(56) References Cited

U.S. PATENT DOCUMENTS

| | | | | |
|---|---|---|---|---|
| 6,576,898 | B2 | 6/2003 | Waki | 250/292 |
| 2001/0054688 | A1 | 12/2001 | Waki | 250/294 |
| 2004/0051038 | A1 | 3/2004 | Taniguchi | 250/288 |
| 2006/0038121 | A1 * | 2/2006 | Guevremont | 250/290 |

FOREIGN PATENT DOCUMENTS

| | | |
|---|---|---|
| JP | 2000-149865 | 5/2000 |
| JP | 2001-351563 | 12/2001 |
| JP | 2004-111149 | 4/2004 |
| WO | WO 2006/098230 A1 | 9/2006 |

OTHER PUBLICATIONS

Translation of the International Preliminary Report on Patentability.
Chinese language office action dated Aug. 8, 2012 and its English language translation issued in corresponding Chinese application 200880127811.0.
Chinese Office Action dated Mar. 5, 2013 for corresponding Chinese Patent Application No. 200880127811.0, English translation of "Reason for Rejection".

* cited by examiner

*Primary Examiner* — Robert Kim
*Assistant Examiner* — Hanway Chang
(74) *Attorney, Agent, or Firm* — Bingham McCutchen LLP

(57) ABSTRACT

One virtual rod electrode (11) is composed by arraying a plurality of plate electrodes (111, . . . , 118) along an ion beam axis, and a quadrupole ion optical element (1) is constructed by arranging four virtual rod electrodes (11, 12, 13 and 14) around an ion beam axis C. A voltage-applying unit alternately applies two radio-frequency voltages having a phase difference of 180 degrees for each of the plate electrodes in one virtual rod electrode. By this voltage application, the quadrupole component of the radio-frequency electric field created within a space surrounded by the four virtual rod electrodes is decreased, while higher-order multipole components are increased. The quadrupole component yields high ion convergence and mass selectivity, while the higher-order components provide high ion transmission efficiency and ion acceptance. The general ion transport efficiency can be improved by appropriately adjusting the ion optical characteristics according to the installation environment of the ion optical system and the conditions before and after the ion optical system.

20 Claims, 8 Drawing Sheets

MASS SPECTROMETER

CROSS-REFERENCE TO THE RELATED APPLICATIONS

This application is a national stage of international application No. PCT/JP2008/000451, filed on Mar. 5, 2008, the entire contents of which are incorporated herein by reference.

TECHNICAL FIELD

The present invention relates to a mass spectrometer, and more specifically to an ion optical system for transporting ions to subsequent stages in the mass spectrometer.

BACKGROUND ART

In mass spectrometers, an ion optical system, which is also referred to as an ion lens or ion guide, is used to converge ions supplied from the previous stage, accelerate them in some cases, and send them to a mass analyzer (e.g. a quadrupole mass filter) in the next stage. Some conventional ion optical systems use multipole rod configurations, such as a quadrupole or octapole system. In the case of a quadrupole mass filter, which is often used as a mass analyzer for separating ions according to their mass, a set of short pre-rod electrodes may be additionally provided before the main quadrupole rod electrodes to smoothly introduce ions into the main rod electrodes. Furthermore, a set of short post-rod electrodes may also be provided after the main quadrupole rod electrodes to prevent the movement of ions from being disturbed due to a disturbance of the electric field at the rear end of the quadrupole rod electrodes. These pre-rod and post-rod electrodes are also a type of ion optical systems.

FIG. 15(A) is a schematic perspective view of a common type of quadrupole rod ion guide 710, and FIG. 15 (B) is a plan view of this ion guide 710 in an x-y plane perpendicular to its ion beam axis C. The ion guide 710 includes four cylindrical rod electrodes 711-714 arranged parallel to each other so as to surround the ion beam axis C. Normally, as shown in FIG. 15(B), the pair of rod electrodes 711 and 713 opposing each other across the ion beam axis C are supplied with a radio-frequency voltage $V\cdot\cos\omega t$, while the other pair of rod electrodes 712 and 714 neighboring the first pair around the ion beam axis C are supplied with a radio-frequency voltage $V\cdot\cos(\omega t+\pi)=-V\cdot\cos\omega t$, i.e. a voltage having the same amplitude as that of the first radio-frequency voltage $V\cdot\cos\omega t$ with a phase shift of 180 degrees (i.e. with a reversed polarity). Applying the radio-frequency voltages $\pm V\cdot\cos\omega t$ in this manner creates a quadrupole radio-frequency electric field within a space surrounded by the four rod electrodes 711-714. Within this electric field, ions are transported to the next stage while being oscillated and converged close to the ion beam axis C.

FIG. 16 is a plan view of an octapole rod ion guide 720 in an x-y plane perpendicular to its ion beam axis C. The eight cylindrical rod electrodes 721-728 are arranged at equal angular intervals around the ion beam axis C and in contact with an inscribed cylinder A. The manner of applying radio-frequency voltages to these rod electrodes 721-728 is the same as in the case of the quadrupole configuration: the same radio-frequency voltage is applied to any two rod electrodes opposing each other across the ion beam axis C, and two radio-frequency voltages having a phase shift of 180 degrees are respectively applied to any two rod electrodes neighboring each other around the ion beam axis C.

In the multipole rod ion optical system with four or more poles, the profile of the radio-frequency electric field formed within the space surrounded by the rod electrodes changes depending on the number of poles. This change is accompanied by some changes in the ion optical characteristics, such as the ion beam convergence, ion transmission efficiency, ion acceptance, ion-storing capacity and mass-separating capability. In general, using a smaller number of poles improves the beam convergence and mass-selecting capability due to the cooling effect caused by a collision with neutral molecules; increasing the number of poles lowers the beam convergence and mass-selecting capability while improving the transmission efficiency and acceptance of the ions.

Patent Documents 1, 2 and other documents disclose an ion optical system using virtual rod electrodes. FIG. 17 is a schematic configuration diagram of an ion optical system using virtual rod electrodes. In this ion optical system 730, the rod electrodes 711, 712, 713 and 714 shown in FIG. 15(A) are respectively replaced with four virtual rod electrodes 731, 732, 733 and 734, each of which is composed of a plurality of plate electrodes 735 arranged along the ion beam axis C. (Although four plate electrodes are used in the example of FIG. 17, this number can be arbitrarily changed.) The radio-frequency voltages applied to these virtual rod electrodes 731-734 are the same as those applied to the real rod electrodes 711-714 shown in FIG. 15(B).

However, in the case of the virtual rod electrodes 731-734, it is possible to apply a different voltage to each of the plate electrodes forming one virtual rod electrode. Therefore, for example, a DC voltage that increases in a stepwise manner along the moving direction of the ions is superimposed on the radio-frequency voltage. The DC electric field created by this DC voltage has the effect of accelerating or decelerating the ions passing through the space surrounded by the virtual rod electrodes 731-734. Thus, the acceleration or deceleration of the ions can be easily performed. Furthermore, in the present configuration, the plate electrodes forming one virtual rod electrode can be arranged so that they come closer to the ion beam axis C with the movement of the ions. In this configuration, the space within which the ions can oscillate becomes smaller with the movement of the ions. Consequently, the ions are converged closer to the ion beam axis C so that, for example, they can be efficiently guided through a small hole formed at the tip of a skimmer and transported to the next stage.

Patent Document 1: Japanese Unexamined Patent Application Publication No. 2000-149865

Patent Document 2: Japanese Unexamined Patent Application Publication No. 2001-351563

DISCLOSURE OF THE INVENTION

Problem to be Solved by the Invention

As already explained, the ion optical characteristics of the conventional multipole rod ion optical system vary depending on the number of poles. Therefore, the system is normally designed so that the number of poles is appropriately selected according to the atmospheric conditions (e.g. gas pressure) under which the ion optical system will be used, the relation of the ion optical system with other ion-optical elements provided before or after itself and other factors, and the necessary parameters (e.g. the diameter and length of the rod electrodes) are determined for the selected number of poles. However, the conventional ion optical system has a limited range of choice for the parameters and does not always allow the use of an ion optical system having optimal ion optical characteristics for the intended application. Therefore, in some cases, it is difficult to improve the detection sensitivity or accuracy of the system.

By contrast, in the conventional virtual-rod ion optical system, each virtual rod electrode is composed of a plurality of plate electrodes and their geometrical arrangement can be chosen with high degrees of freedom, so that the plate electrodes can be arranged in a special manner to improve the convergence of the ions, as in the previously described case. Furthermore, the acceleration or deceleration of ions can be achieved by applying a DC voltage in a stepwise manner. However, composing one virtual rod electrode from many plate electrodes inevitably increases the number of parts, and the task of assembling and adjusting those plate electrodes is difficult since they must be accurately arranged. Therefore, it is difficult to construct a virtual-rod electrode system with eight or more poles.

In recent years, a higher sensitivity, higher accuracy, higher throughput, and other improvements in a mass spectrometer have been required in order to deal with the growing diversity and complexity of the kind of substances to be analyzed, the demand for a prompt analysis, and other requests. To meet such demands, it is also necessary to improve the performance of the ion optical system. However, improving the system performance on the basis of the conventional multipole rod configuration has practical limitations due to the aforementioned reasons. In the case of the virtual-rod multipole configuration, improving the ion transmission efficiency and other ion optical characteristics by increasing the number of poles is rather impractical mainly because of its high cost.

The present invention has been developed to solve the aforementioned problems, and its main objective is to provide a mass spectrometer whose detection sensitivity and analysis accuracy are enhanced by improving the performance an ion optical system which converges ions coming from the previous stage, accelerates or decelerates these ions in some cases, and sends them to the next stage.

Another objective of the present invention is to provide a mass spectrometer having an ion optical system capable of easily and inexpensively realizing the required properties, such as the ion transmission efficiency, ion acceptance and mass-selecting capability, according to the atmospheric gas pressure or other usage conditions.

Means for Solving the Problems

No extensive analysis has previously been made on the radio-frequency electric field created in the aforementioned type of virtual multipole rod ion optical system; it has been taken for granted that this system should create a radio-frequency electric field similar to the one created by a normal multipole rod ion optical system with the same number of poles. The present inventor has conducted an analysis focused on the radio-frequency electric field created in a virtual quadrupole rod ion optical system and found that, unlike the normal quadrupole rod ion optical system, the virtual quadrupole rod ion optical system creates an electric field that abundantly contains not only the quadrupole component but also higher-order multipole components. This finding suggested that, if the quadrupole component of the electric field can be suppressed to relatively increase the higher-order multipole components, it will be possible to create a system having only four poles yet capable of achieving ion optical characteristics comparable to those of a system with eight or more poles.

In the virtual multipole rod ion optical system, each virtual rod electrode is composed of a plurality of plate electrodes, and this structural characteristic allows different voltages to be respectively applied to the plate electrodes belonging to one virtual rod electrode. As stated previously, this idea has already been realized as far as the DC voltage is concerned; that is, the DC voltage is varied in a stepwise manner with the movement of the ions. However, the radio-frequency voltage for oscillating the ions is uniformly applied. Focusing on this point, the present inventors have reached the technique of suppressing lower-order radio-frequency components and increasing higher-order radio-frequency components by varying the phase of the higher-order radio-frequency voltage applied to the plate electrodes forming one virtual rod electrode. Computational simulations have confirmed that this technique can produce adequate effects with a practically feasible system configuration. Thus, the present invention has been obtained.

That is, the present invention aimed at solving the aforementioned problems is a mass spectrometer having an ion optical system for transporting ions to the next stage, which is characterized in that the ion optical system includes:

a) a virtual multipole rod ion optical element having 2×N pieces of virtual rod electrodes (where N is an integer equal to or greater than two) arranged so as to surround an ion beam axis, each virtual rod electrode being composed of M pieces of plate electrodes spaced along the ion beam axis (where M is an integer equal to or greater than three); and b) a voltage-applying means for applying radio-frequency voltages in the following manner: in each set of the 2×N plate electrodes arranged around the ion beam axis, the same radio-frequency voltage is applied to any two plate electrodes opposing each other across the ion beam axis, and two radio-frequency voltages having the same amplitude and a phase difference of 180 degrees are respectively applied to any two plate electrodes neighboring each other around the ion beam axis; and in each set of the M plate electrodes forming one virtual rod electrode, the phase of the radio-frequency voltage applied to at least one of the plate electrodes is different from the phase of the radio-frequency voltage applied to another plate electrode.

The voltage-applying means may apply, to each plate electrode, not only the radio-frequency voltage but also a DC voltage, such as a bias voltage, superimposed on the radio-frequency voltage.

The ion beam axis does not need to be a linear axis; it may be polygonal or curved, according to which virtual rod electrodes may also have a polygonal or curved shape.

For example, when N=2, the ion optical element becomes a virtual quadrupole rod electrode. In this case, the quadrupole component of the electric field is maximized when the radio-frequency voltages applied to one virtual rod electrode are identical (i.e. when they have the same amplitude and phase). On the other hand, when a radio-frequency voltage having a different phase is applied to some of the plate electrodes, the quadrupole component of the electric field is decreased at least within the region near the plate electrodes to which the aforementioned radio-frequency voltage having the different phase is applied; instead, an electric-field component having a larger number of poles increases. Increasing the amount of the quadrupole electric-field component improves the ion beam convergence, and increasing an electric-field component whose number of poles is greater than four improves the ion transmission efficiency and ion acceptance. Accordingly, by decreasing the quadrupole component of the electric field to increase higher-order multipole components within some region in the aforementioned manner, one can improve the ion transmission efficiency and ion acceptance within a space around that region.

Effects of the Invention

In the mass spectrometer according to the present invention, even if a virtual rod ion optical system having a quadrupole or similar low-order multipole configuration is used, the ion transmission efficiency, ion acceptance and other system performances can be improved over the entire system or within a local region along the ion beam axis. This makes it possible to adjust the ion optical characteristics so that the ion can be transported in the most appropriate manner according to the installation environment of the ion optical system, the conditions before and after the ion optical system, and other factors. For example, the transmission efficiency and acceptance of the ions may be regarded as important at an ion-inlet region, while the ion convergence may be given the first priority at an ion-exit region. In this manner, the amount of objective ions that will eventually reach an ion detector can be increased so as to attain high levels of detection sensitivity.

As one mode of the present invention, it is preferable that the voltage-applying means applies a radio-frequency voltage having the same amplitude as that of the radio-frequency voltage applied to another plate electrode and a phase difference of 180 degrees, to at least one of the M pieces of the plate electrodes forming each virtual rod electrode.

Applying radio-frequency voltages having a phase difference of 180 degrees (i.e. with reversed polarities) to the plate electrodes neighboring each other along the ion beam axis is highly effective in cancelling the quadrupole component of the electric field. In the present invention, two kinds of radio-frequency voltages having the same amplitude and a phase difference of 180 degrees are originally prepared as the voltages to be applied to the 2×N plate electrodes arranged so as to surround the ion beam axis, and these voltages can also be directly used in the present case. Therefore, modifying a conventional virtual multipole rod ion optical system to the present invention can be achieved by simply changing the wiring connections for supplying the voltages to the plate electrodes. Thus, it is possible to minimize the cost increase.

As a preferable mode of the present invention, the voltage-applying means may be configured so that radio-frequency voltages having a phase difference of 180 degrees are alternately applied for every group consisting of one or more of the plate electrodes neighboring each other along the ion beam axis at least in a part of the M-piece plate electrodes forming each virtual rod electrode.

The number of plate electrodes neighboring each other along the ion beam axis constituting a group for which the phase of the radio-frequency voltage is inverted from another group can be determined according to the required ion optical characteristics. Choosing a smaller number results in a larger decrease in the quadrupole component of the electric field and a larger increase in the higher-order multipole components. However, the number of plate electrodes to form one virtual rod electrode and the number of mutually neighboring plate electrodes to which the radio-frequency voltage with the same phase is applied must be appropriately selected so as to ensure the periodicity of the phase inversion of the radio-frequency voltages. It is normally necessary to increase the former number with an increase of the latter.

In the mass spectrometer according to the present invention, it is possible that the M pieces of the plate electrodes forming each virtual rod electrode include an electrode group in which the radio-frequency voltages having a phase difference of 180 degrees is alternately applied for every first number of plate electrodes neighboring each other along the ion beam axis, and another electrode group in which the radio-frequency voltages having a phase difference of 180 degrees is alternately applied for every second number of plate electrodes neighboring each other along the ion beam axis, where the second number differs from the first number.

In this case, there are two or more phase inversion periods of the radio-frequency voltages when viewed along the direction of the ion beam axis. Since these periods also affect the ion optical characteristics, it is possible to appropriately adjust the location and/or period of the phase inversion according to the usage environment of the ion optical system and the conditions before and after the ion optical system so as to optimize the ion optical characteristics.

In the mass spectrometer according to the present invention, it is possible that the M pieces of the plate electrodes forming each virtual rod electrode include an electrode group in which the radio-frequency voltages having a phase difference of 180 degrees are alternately applied for every predetermined number of plate electrodes neighboring each other along the ion beam axis, and another electrode group in which the same radio-frequency voltage is applied.

When viewed along the direction of the ion beam axis, this configuration can be regarded as a hybrid of a virtual multipole rod ion optical system characteristic of the present invention and a conventional virtual multipole rod ion optical system. This configuration also allows the location and/or period of the phase inversion to be appropriately adjusted according to the usage environment of the ion optical system and the conditions before and after the ion optical system so as to optimize the ion optical characteristics.

In the present invention, N may be any number equal to or greater than two. However, taking into account the cost and the required ion optical characteristics, it is practically recommended to choose N=2, i.e. to adopt the configuration of a virtual quadrupole rod ion optical system.

Similarly, there is no specific limitation on M. However, it is necessary to take into account the aforementioned periodicity of the phase inversion of the radio-frequency voltages in the direction of the ion beam axis. Furthermore, when considering the ion optical characteristics, it is often recommended to exclude the plate electrodes at both ends of the virtual rod electrode since the radio-frequency electric field created by these plate electrodes does not have an ideal profile. Accordingly, as one mode of the present invention, it is preferable that: the voltage-applying means is configured so that the radio-frequency voltages having a phase difference of 180 degrees are alternately applied for each of the plate electrodes neighboring each other along the ion beam axis at least in a part of the M-piece plate electrodes forming each virtual rod electrode; and M is equal to or greater than four.

The ion optical system as the characteristic element of the present invention can be used in various sections of the mass spectrometer in which ions need to be transported to subsequent stages. The system is particularly useful when different ion optical characteristics are required at the inlet and outlet sides or when it is necessary to transportions under harsh conditions, e.g. under a relatively low degree of vacuum.

Specifically, the mass spectrometer according to the present invention may include an ion source for ionizing a sample component under approximately atmospheric pressure and a mass separator for separately detecting ions according to their mass under high vacuum, with one or more intermediate vacuum chambers provided between the ion source and the mass separator, the ion source communicating with the intermediate vacuum chamber next to it via either a small ion-passage hole or a thin ion-passage pipe, and the ion optical system being placed within this intermediate vacuum chamber.

In this case, atmospheric gas flows from the ion source into the intermediate vacuum chamber via the ion passage hole or ion passage pipe. The ions conveyed by this gas tend to widely spread after being introduced into the intermediate vacuum chamber. However, these ions can be efficiently accepted into and transported within the ion optical system by suppressing the quadrupole component of the electric field and increasing the higher-order multipole components at the inlet side of the ion optical system so as to improve the ion transmission efficiency and the ion acceptance. At the outlet side of the ion optical system, the quadrupole component of the electric field can be relatively increased to enhance the ion convergence so as to minimize the loss of the ions at the micro-sized ion-passage hole. In this manner, the ion transmission efficiency can be generally improved and a higher level of ion-detection sensitivity can be attained.

The mass spectrometer according to the present invention may also include a collision chamber placed under a high vacuum atmosphere, the collision chamber being used for dissociating an ion by bringing the ion into collision with a collision-induced dissociation gas supplied into the collision chamber, and the ion optical system being placed within this collision chamber.

By this configuration, a precursor ion that has been mass-separated by a quadrupole mass filter or similar device in the previous stage can be efficiently introduced and dissociated by collision-induced dissociation, and the product ions thereby created can be converged close to the ion beam axis to be efficiently introduced into a quadrupole mass filter or similar device in the next stage. As a result, the detection sensitivity of the product ions improves, which contributes to an improvement in the accuracy of the qualitative and structural analyses of an objective sample component.

EXPLANATION OF NUMERALS

Figure 1:
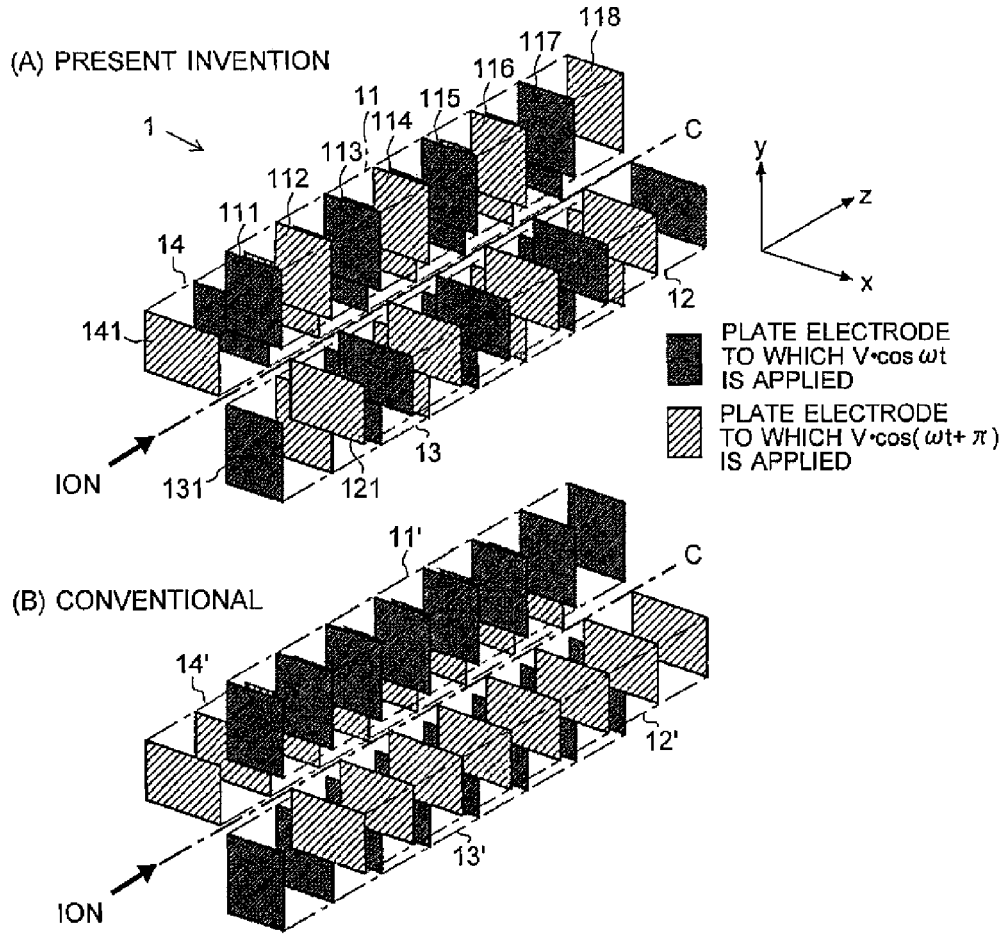
FIG. 1(A) is a perspective view showing the configuration of the ion optical element of an ion optical system according to one embodiment of the present invention.
FIG. 1(B) is a perspective view showing the configuration of the ion optical element of a conventional ion optical system.

1 . . . . Ion Optical Element
11, 12, 13, 14 . . . . Virtual Rod Electrode
111, 112, 113, 114, 115, 116, 117, 118, 119, 11A, 11B, 11C, 121, 131 . . . . Plate Electrode
2 . . . . Mass Spectrometer
20 . . . . Ionization Chamber
21 . . . ESI nozzle
22 . . . . Desolvation Pipe
23 . . . . First Intermediate Vacuum Chamber
24 . . . . First Ion Guide
241 . . . . First Half
242 . . . . Second Half
25 . . . . Electrostatic Lens
26 . . . . Passage Hole
27 . . . . Second Intermediate Vacuum Chamber
28 . . . . Second Ion Guide
29 . . . . Analysis Chamber
30 . . . . Pre-rod Electrode
31 . . . . Quadrupole Mass Filter
32 . . . . Ion Detector
35 . . . . Radio-Frequency Voltage Generator
36 . . . DC Voltage Generator
37 . . . . Adder
40 . . . . First Quadrupole Mass Filter
41 . . . . Collision Cell
42 . . . . Ion Injection Hole
43 . . . . Ion Ejection Hole
44 . . . . Second Quadrupole Mass Filter
A . . . . Inscribed Cylinder
A' . . . . Inscribed Elliptic Cylinder
C . . . . Ion Beam Axis

BEST MODE FOR CARRYING OUT THE INVENTION

The basic configuration and operational principle of the ion optical system in the mass spectrometer according to the present invention is hereinafter described by means of FIGS. 1-6, taking one typical embodiment.

FIG. 1(A) is a perspective view showing the configuration of an ion optical element 1 of an ion optical system according to the present embodiment, and FIG. 1(B) is a perspective view showing the configuration of an ion optical element of a conventional ion optical system. FIG. 2(A) is a schematic plan view in an x-y plane perpendicular to the ion beam axis C of the ion optical element 1 according to the present embodiment shown in FIG. 1(A), and FIG. 2(B) is a schematic right-side view of FIG. 2(A).

The present ion optical element 1 is composed of a plurality of electrode sets (eight sets in the present embodiment) arranged along the ion beam axis C (z-direction), each electrode set consisting of plate electrodes (e.g. 111, 121, 131 and 141) symmetrically arranged around the ion beam axis C at angular intervals of 90 degrees in an x-y plane perpendicular to the ion beam axis C. The plate electrodes are rectangular members made of a metal or another material having an electrical conductivity comparable to a metal, having the same thickness and a width of 2r. The distance between any two plate electrodes neighboring each other along the ion beam axis C (e.g. the plate electrodes 111 and 112) is a constant value of d. This ion optical element 1 can also be regarded as a structure consisting of four virtual rod electrodes 11, 12, 13 and 14 surrounding the ion beam axis C, each virtual rod electrode (e.g. 11) being composed of eight plate electrodes (e.g. 111, 112, . . . and 118) arranged parallel to the ion beam axis C. As shown in FIG. 2(A), the four plate electrodes 111, 121, 131 and 141 surrounding the ion beam axis C in the x-y plane are in contact with an inscribed cylinder A of radius R with its central axis coinciding with the ion beam axis C.

As shown in FIG. 2(A), any two plate electrodes opposing each other across the ion beam axis C forms a pair, and the same radio-frequency voltage is applied to this pair of plate electrodes. Specifically, the plate electrodes 111 and 131 form one pair, to which a radio-frequency voltage $-V\cdot\cos\omega t$ is applied. On the other hand, the plate electrodes 121 and 141, which neighbor the aforementioned plate electrodes 111 and 131 around the ion beam axis C, form another pair, to which a radio-frequency voltage $V\cdot\cos(\omega t+\pi)$ having a phase difference of 180 degrees from the previous radio-frequency voltage $V\cdot\cos\omega t$, i.e. a radio-frequency voltage $-V\cdot\cos\omega t$ having a reversed polarity, is applied. When only the voltages applied to the four plate electrodes lying in one x-y plane are considered, the present system is basically identical to the previously described conventional virtual multipole rod ion optical system.

In the case of a conventional virtual multipole rod ion optical system, as shown in FIG. 1(B), one radio-frequency voltage with a specific phase is commonly applied to the eight plate electrodes forming one virtual rod electrode (e.g. 11'). This is the same as in the case where a radio-frequency voltage is applied to one real rod electrode instead of the virtual rod electrode. By contrast, in the ion optical system in the present embodiment, two radio-frequency voltages having a phase difference of 180 degrees, $V\cdot\cos\omega t$ and $V\cdot\cos(\omega t+\pi)$, are alternately applied for each of the eight plate electrodes forming one virtual rod electrode. For example, in the virtual rod electrode 11, the radio-frequency voltage $V\cdot\cos\omega t$ is applied to the four electrodes 111, 113, 115 and 117, and the radio-frequency voltage $V\cdot\cos(\omega t+\pi)$ is applied to the other plate electrodes 112, 114, 116 and 118. This is also true for the other three virtual rod electrodes 12, 13 and 14. Such a voltage application is impossible in the case of the real or solid rod electrodes.

In the ion optical system of the present embodiment, the radio-frequency voltages are applied, as described previously, in a manner totally different from the conventional method, whereby a radio-frequency electric field having a profile (potential gradient) entirely different from the conventional case is created in the space surrounded by the four virtual rod electrodes 11, 12, 13 and 14. This naturally causes a change in the action or effect on the ions. This point is hereinafter explained.

As will be described later, a DC voltage may be superimposed on the radio-frequency voltages applied to each plate electrode of the ion optical system 1. However, the following description initially ignores the DC voltage since it is for the moment unnecessary to consider the effect of the DC electric field.

A comparison is hereinafter made between the potentials in the radio-frequency electric fields respectively created by the conventional ion optical system shown in FIG. 1(B) and the ion optical system of the present embodiment shown in FIG. 1(A).

It is commonly known that a potential created by multipole rod electrodes can be expressed by the following multipole expansion:

$$\Phi(r,\Theta)=\Sigma K_n\cdot(r/R)^n\cdot\cos(n\Theta) \quad (1),$$

where $\Sigma$ is the sum for all the values of n, which is a positive integer representing the order of the multipole electric field. $K_n$ is the expansion coefficient representing the magnitude of the 2n-pole component of the electric field, and R is the radius of the inscribed cylinder A. The magnitude of the quadrupole component of the electric field is given by $K_2$, i.e. the expansion coefficient for n=2. The orders of the higher-order multipole electric-field components having the symmetry of quadrupole are n=6, 10, 14, . . . , and 2(2k−1).

Figure 3:
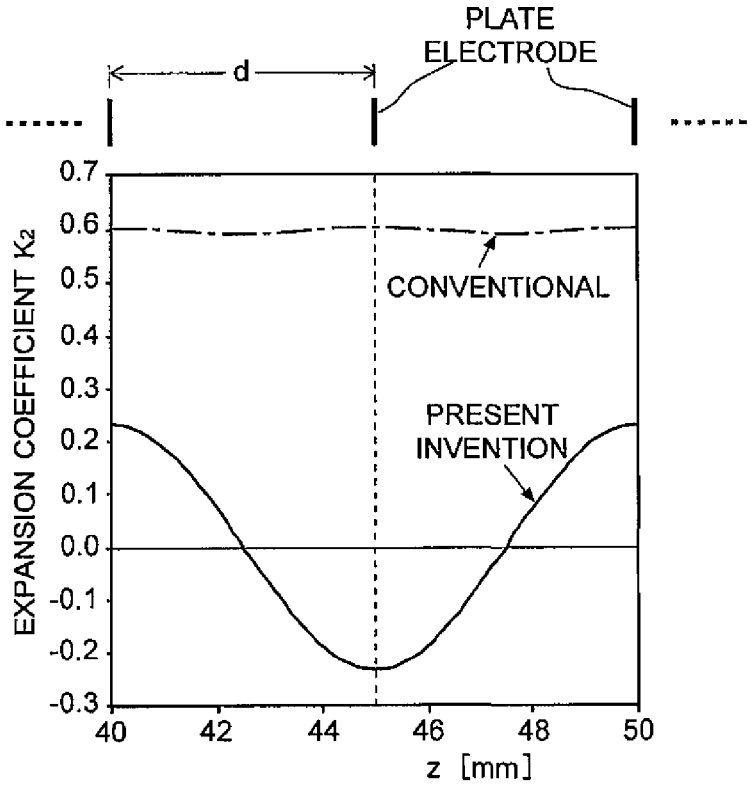
FIG. 3 is a graph showing the results of numerical calculations of expansion coefficients $K_2$ in the ion optical system of the present embodiment and the conventional ion optical system.

The expansion coefficients $K_2$ obtained by numerical calculations for the ion optical system of the present embodiment and the conventional ion optical system are shown in FIG. 3. The calculation conditions were that the interval of the plate electrodes was d=5 mm and these plate electrodes were arranged at intervals of 5 mm within a range from 0 to 90 mm on the z-axis. That is, within the range shown in FIG. 3, three plate electrodes were located at z=40, 45 and 50 mm, respectively, as indicated in the upper portion of FIG. 3, and the other plate electrodes were also located at intervals of 5 mm within the ranges below z=40 mm and above z=50 mm. The aforementioned calculation condition completely eliminates the influence of the disturbance of the electric fields at both the inlet and outlet ends of the virtual rod electrodes.

As is evident from FIG. 3, the expansion coefficient $K_2$ of the conventional ion optical system is approximately 0.6, while the absolute value of the expansion coefficient $K_2$ of the ion optical system of the present embodiment is approximately 0.2 or less. This means that the magnitude of the quadrupole component of the electric field has been reduced to approximately one third of the conventional level or even smaller. It should be noted that the inversion of the (positive/negative) polarity of the expansion coefficient $K_2$ for every step in the z-direction of the ion optical system in the present embodiment is merely a result of the inversion in the phase of the applied radio-frequency voltages and has no particular significance.

This result demonstrates that the quadrupole component of the electric field created by the ion optical system of the present embodiment is reduced from the levels in the conventional case. Since the ion transmission/storage efficiency of the quadrupole electric field is more dependent on the mass than that of the higher-order multipole electric fields, it is expected that using the ion optical system of the present embodiment will make the ion transmission/storage efficiency less dependent on the mass than ever before.

Figure 4:
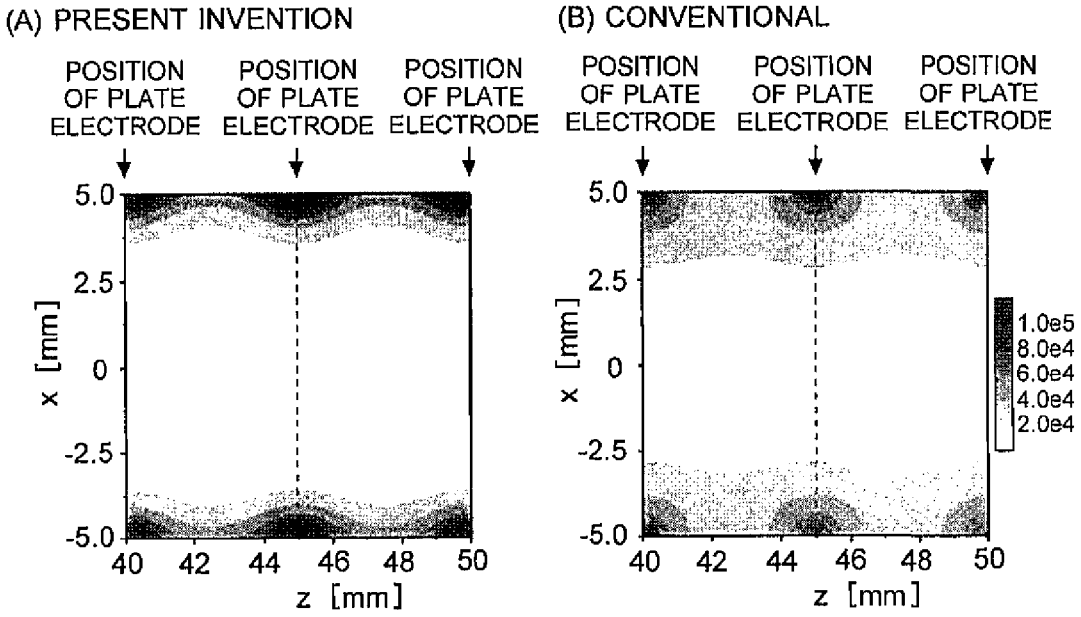
FIG. 4 is a graph showing the results of numerical calculations of pseudopotentials in the ion optical system of the present embodiment and the conventional ion optical system.
Figure 5:
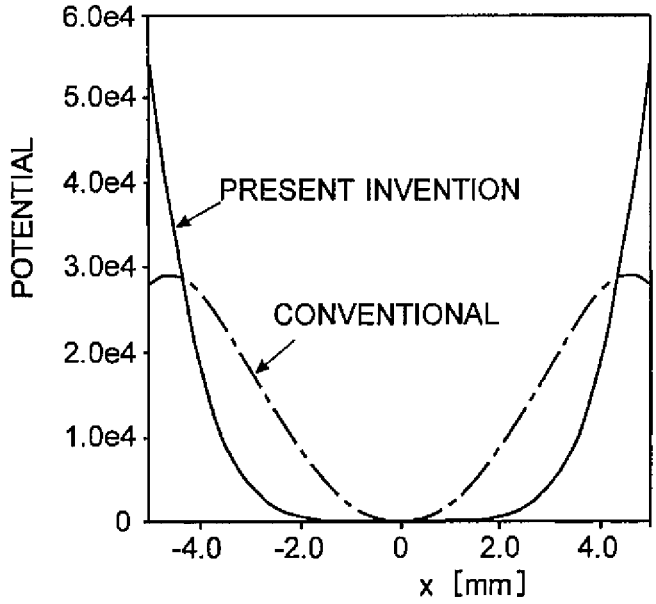
FIG. 5 is a graph showing the results of numerical calculations of pseudopotentials in the ion optical system of the present embodiment and the conventional ion optical system.

In general, the motion of an ion in a radio-frequency electric field can be separated into a micro oscillation, which depends on the frequency of the radio-frequency electric field, and a secular motion, which is independent of that frequency. On a macroscopic level, the ion's motion is represented by the secular motion, in which case a physical quantity called "pseudopotential" can be derived as a potential that determines the secular motion. That is to say, the ion optical characteristics of an ion optical system creating a radio-frequency electric field can be qualitatively understood by analyzing the pseudopotential. FIGS. 4 and 5 show the results of numerical calculations of the pseudopotentials in the ion optical system according to the present embodiment and a conventional ion optical system. The geometrical structure of the plate electrodes is the same as in the previous calculation.

FIGS. 4(A) and 4(B) are potential distribution diagrams in which the pseudopotentials in the ion passage spaces of the ion optical system of the present embodiment and the conventional ion optical system are shown by means of contour lines. FIG. 5 shows the section at a certain point z on the potential distribution diagrams shown in FIGS. 4(A) and 4(B), i.e. the relation between the position in the x-direction and the potential. In these figures, the point x=0 mm lies on the ion beam axis C. The inner edges of the plate electrodes are located at x=±5 mm. These figures confirm that a significant difference in the shape of the pseudopotential exists between the ion optical system of the present embodiment and the conventional ion optical system.

FIG. 4(B) shows that the pseudopotential of the conventional ion optical system has troughs between the plate electrodes neighboring each other in the z-direction. This means that no electric field is created between the plate electrodes of the conventional ion optical system since the same radio-frequency voltage is applied to all the plate electrodes belonging to one virtual rod electrode, so that the ion-confining effect between the plate electrodes is weakened. By contrast, as shown in FIG. 4(A), the ion optical system of the present embodiment creates an electric field between the plate electrodes belonging to one virtual rod electrode as well, so that no trough of the pseudopotential is present between the plate electrodes.

Furthermore, FIG. 5 shows that the pseudopotential in the conventional ion optical system has a shape approximate to a quadratic function since the quadrupole component of the electric field is dominant (i.e. the value of the second-order expansion coefficient $K_2$ is large). By contrast, the pseudopotential in the ion optical system of the present embodiment is flat around the center (x=0); it rises steeply only in the vicinities of the plate electrodes. That is, its shape cannot be expressed as a quadratic function but some higher-order function.

The previous analysis of the pseudopotential suggests that the ion optical system of the present embodiment has a significant ion-confining effect in the space between the plate electrodes neighboring each other along the ion beam axis C and is highly suitable for the transport and/or storage of ions. On the other hand, as is evident from the shape of the pseudopotential, the conventional ion optical system can confine ions into narrower spaces. Therefore, it can be said that the conventional structure is advantageous in ion-converging capability.

The present inventors have calculated the ion transmission efficiency by a computer simulation to confirm the superiority of the ion optical system of the present embodiment in terms of the ion transport/storage capability. In this simulation, the ion transmission efficiency was calculated by computing 100 ion trajectories and counting the number of ions arriving at predetermined points in both the ion optical system of the present embodiment and the conventional ion optical system. Any ion whose trajectory was diverted to the outside of the inscribed cylinder A before arriving at the predetermined points was regarded as a lost ion. The initial conditions of the ions were created by random numbers, and their initial positions were set to be approximately as large as the inscribed cylinder A. These strict initial conditions were intended to prevent the ion transmittance efficiency from reaching 100%. Naturally, the amplitude and frequency of the radio-frequency voltages were common to both the ion optical system of the present invention and the conventional ion optical system.

Figure 6:
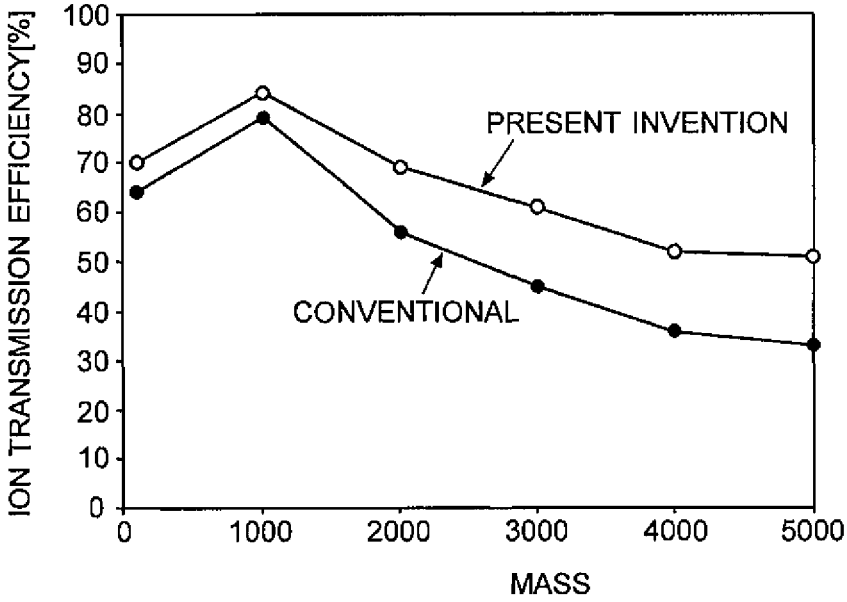
FIG. 6 is a graph showing the results of numerical calculations of ion transmission efficiencies in the ion optical system of the present embodiment and the conventional ion optical system.

FIG. 6 is a graph showing the calculated result of the ion transmission efficiency. As is evident from this graph, the ion optical system of the present embodiment has achieved higher ion transmission efficiencies over the entire mass range. The figure also shows that the ion optical system of the present embodiment has a lower rate of decrease of the ion transmission efficiency from its maximum value. This means that the ion optical system of the present embodiment is less dependent on the mass. Therefore, the ion optical system of the present embodiment can reduce the change in the detection sensitivity depending on the mass of the ion to be analyzed.

The previously described results lead to the conclusion that, as compared to the conventional ion optical system, the ion optical system according to the present invention can attain higher ion transmission/storage efficiencies and thereby enhance the detection sensitivity. Furthermore, it can also improve the mass dependency of the detection sensitivity.

EXAMPLES

Figure 7:
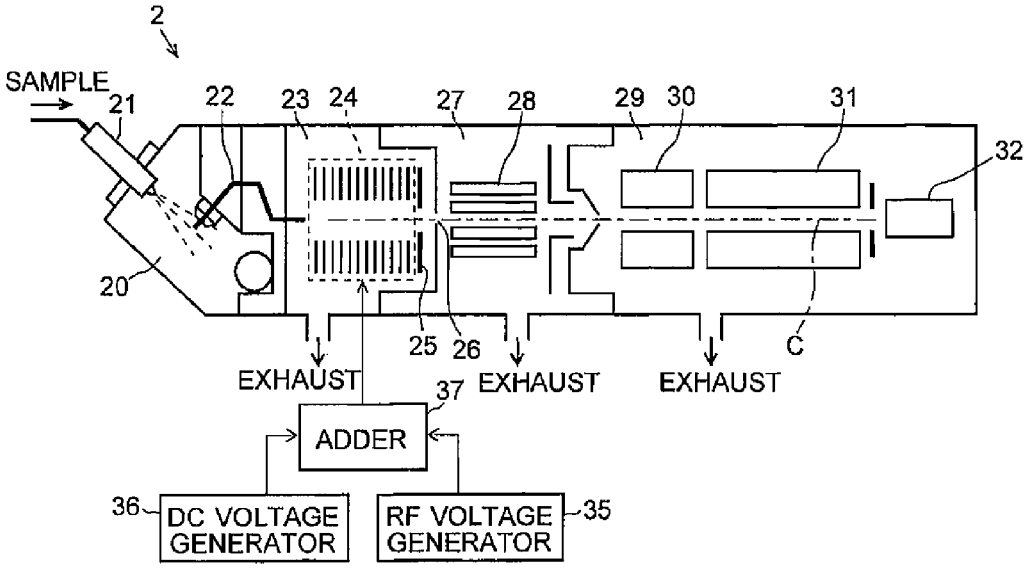
FIG. 7 is a configuration diagram showing the main components of a mass spectrometer which is one example of the present invention.

One example of the mass spectrometer using the previously described characteristic ion optical system is hereinafter described with reference to the drawings. FIG. 7 is a configuration diagram showing the main components of the mass spectrometer of the present example. For example, this is a mass spectrometer equipped with an atmospheric pressure ionization interface for receiving a sample solution separated by a column of a liquid chromatograph or similar device and for performing a mass analysis of various components contained in that solution.

This mass spectrometer 2 is a multi-stage differential pumping system having an ionization chamber 20 at approximately atmospheric pressure and an analysis chamber 29 evacuated by a high-performance vacuum pump (not shown) to maintain a high vacuum atmosphere, with a first intermediate vacuum chamber 23 and a second intermediate vacuum chamber 27 provided between them. The ionization chamber 20 communicates with the first intermediate vacuum chamber 23 through a thin desolvation pipe 22. The first intermediate vacuum chamber 23 communicates with the second intermediate vacuum chamber 27 through a small-sized passage hole 26.

The sample solution is sprayed from an electrospray ionization (ESI) nozzle 21 into the ionization chamber 20 maintained at approximately atmospheric pressure while being supplied with electric charges from that nozzle, whereby the sample components are ionized. Instead of the electrospray ionization method, an atmospheric pressure chemical ionization or other kinds of atmospheric pressure ionization methods may be used to ionize sample components. The ions produced within the ionization chamber 20 and the micro droplets from which the solvent has not been completely vaporized are drawn into the desolvation pipe 22 due to the pressure difference. While passing through the heated desolvation pipe 22, the solvent in the micro droplets is further vaporized and the ionization is promoted.

Inside the first intermediate vacuum chamber 23, a first ion guide 24 and an electrostatic lens 25, which correspond to the ion optical system in the present invention, are arranged along the ion beam axis C. The ions travel through the first ion guide 24 and the electrostatic lens 25 and then pass through the passage hole 26 to enter the second intermediate vacuum chamber 27. The second intermediate vacuum chamber 27 contains a second ion guide 28 composed of eight rod electrodes arranged so as to surround the ion beam axis C. The ions are converged by the second ion guide 28 and sent into the analysis chamber 29. The analysis chamber 29 contains a quadrupole mass filter 31 composed of four rod electrodes and a pre-rod electrode 30 located before the mass filter 31. The pre-rod electrode 30 is composed of four rod electrodes having a shorter length in the direction of the ion beam axis C. Among various kinds of ions, only the ion having a specific mass-to-charge ratio m/z can pass through the quadrupole mass filter 31 and reach the ion detector 32. The ion detector 32 produces a current signal corresponding to the number of received ions and outputs this signal as a detection signal.

A voltage created by adding a radio-frequency voltage generated by a radio-frequency (RF) voltage generator 35 and a DC voltage generated by a DC-voltage generator 36 is applied from an adder 37 to each plate electrode of the first ion guide 24. These correspond to the voltage-applying means in the present invention. Naturally, the present system has more power sources for appropriately applying either a voltage composed of a radio-frequency voltage and a DC voltage or a pure DC voltage to the desolvation pipe 22, electrostatic lens 25, second ion guide 28, pre-rod electrode 30, quadrupole mass filter 31 and other elements, although these power sources are not shown in the drawings.

The pressure difference between the ionization chamber 20 and the first intermediate vacuum chamber 23 is so large that the gas exiting from the mouth of the desolvation pipe 22 generates a turbulent flow having a velocity significantly disordered in irregular directions away from the ion beam axis C. Therefore, the first ion guide 24 needs to have a high level of ion transmission/storage capability. Furthermore, the first ion guide 24 also needs to have an excellent ion-converging capability to prevent the loss of ions at the small-sized passage hole 26 provided between the first intermediate vacuum chamber 23 and the second intermediate vacuum chamber 27. It has conventionally been difficult to achieve both a high ion transmission/storage efficiency and a high ion convergence. This difficulty can be overcome by using the first ion guide 24, which is based on the principle of the present invention.

Figure 8:
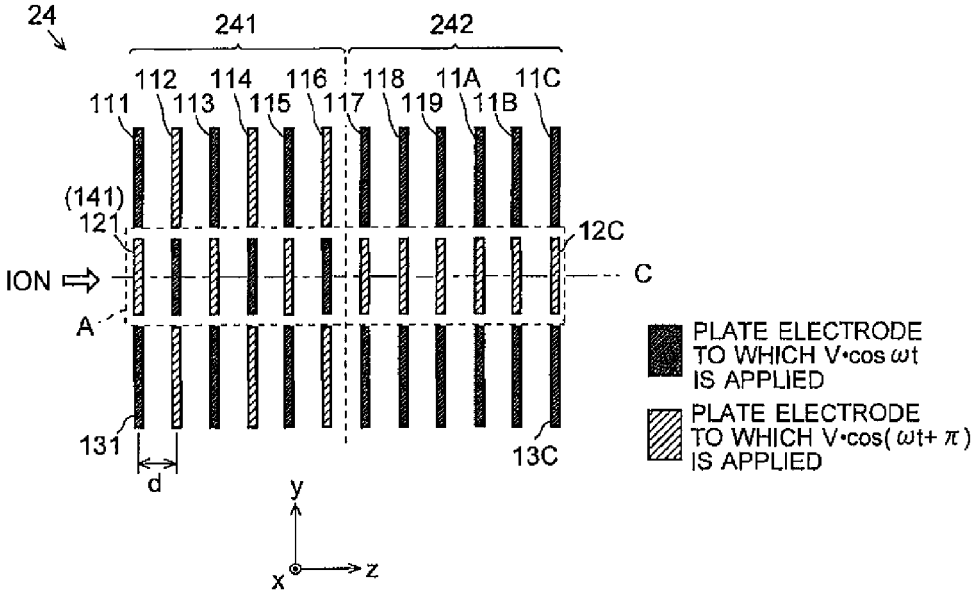
FIG. 8 is a diagram showing the plate electrode array of a first ion guide which corresponds to the ion optical system according to the present invention in the mass spectrometer of the present example.

FIG. 8 is a diagram showing the plate electrode array of the first ion guide 24. This figure corresponds to FIG. 2(B). The electrode arrangement in an x-y plane perpendicular to the ion beam axis C in the first ion guide 24 is the same as shown in FIG. 2(A).

In the first ion guide 24, the number of plate electrodes arrayed along the ion beam axis C, i.e. the number of electrode sets, is 12. However, the phase inversion of the radio-frequency voltage for each plate electrode is not made over the entire array; the ion optical system of the previously described embodiment is adopted only in the first half. That is to say, in the first half 241 which is close to the exit port of the desolvation pipe 22 (the upstream side of the ion stream), e.g. at the six plate electrodes 111, 112, 113, 114, 115 and 116 belonging to one virtual rod electrode, the phase of the radio-frequency voltage is changed by 180 degrees for each plate electrode in the direction of the ion optical axis C. When this first half 241 is separately viewed, its configuration is basically the same as shown in FIG. 2(B), except for the number of electrode sets, i.e. 6 and 8. Therefore, as explained earlier, the electric field it creates contains a relatively small amount of quadrupole component and larger amounts of higher-order multipole components. As a result, a high ion transmission/storage efficiency can be attained even under the situation where the movement of the ions can be easily disordered by a disturbed flow of gas.

On the other hand, in the second half 242 which is close to the passage hole 26 leading to the second intermediate vacuum chamber 27 (the downstream side of the ion stream), e.g. at the six plate electrodes 117, 118, 119, 11A, 11B and 11C belonging to one virtual rod electrode, a radio-frequency voltage having the same phase is applied to all the plate electrodes arrayed along the ion beam axis C. That is, the second half is the same as the conventional ion optical system shown in FIG. 1(B), so that the effect of the quadrupole electric-field component becomes evident. As a result, the ions are efficiently converged to the small-sized passage hole 26, whereby the loss of ions at the passage hole 26 is reduced and the transport efficiency is improved.

As described thus far, the first ion guide 24 in the present example is divided into the first half 241 and the second half 242, each having different ion optical characteristics. By this configuration, the overall ion transport efficiency can be considerably improved.

The first intermediate vacuum chamber 23 is a region where the degree of vacuum is not very high and the ions significantly lose their energy due to collision with a neutral gas. Accordingly, the electrostatic lens 25, to which only a DC voltage is applied, is provided after the first ion guide 24 in order to increase the ion extraction efficiency. Due to the collision with the neutral gas, the ions are instantaneously cooled to the temperature of the neutral gas. As a result, in the vicinity of the electrostatic lens 25, the ions describe trajectories that approximately coincide with the lines of electric force. Therefore, it is possible to improve the ion extraction efficiency by appropriately setting the distribution of the DC voltage generated by the electrostatic lens 25.

In the mass spectrometer 2 of the previous example, there is no specific limitation on the method of ionization in the ionization chamber 20. The first ion guide 24 will exhibit its effect even if the electrospray ionization source is replaced by an atmospheric pressure chemical ionization source, atmospheric pressure photoionization source or any other kind of atmospheric pressure ionization source.

Figure 2:
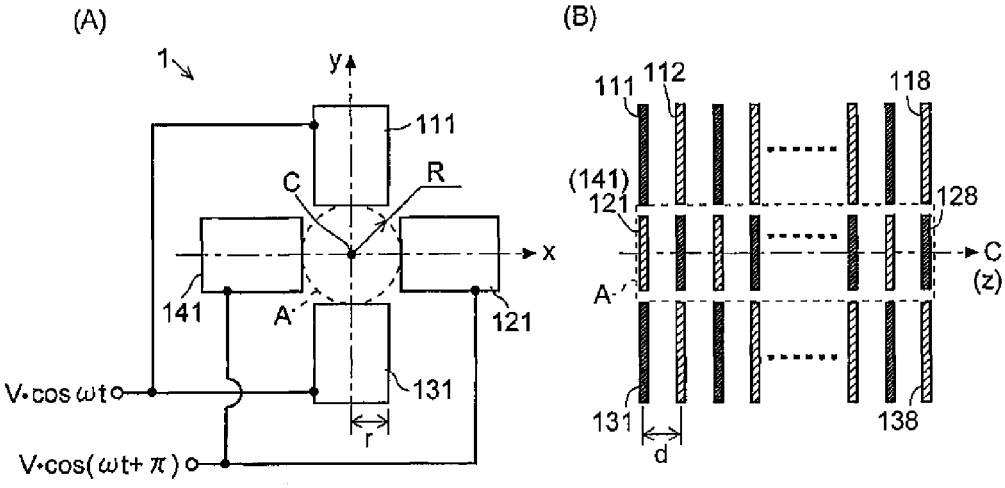
FIG. 2(A) is a schematic plan view in an x-y plane perpendicular to the ion beam axis C of the ion optical element according to the present embodiment shown in FIG. 1(A)
FIG. 2(B) is a schematic right-side view of the same ion optical element.

As is evident from the previous example, it is unnecessary to apply the design of the ion optical system of the embodiment shown in FIG. 2 to all the plate electrodes arrayed along the ion beam axis C. The ion optical system of the embodiment shown in FIG. 2 may be used only in the first half (as in the previous example), second half or middle section according to the required ion optical characteristics.

The number of plate electrodes arrayed along the ion beam axis C (the number of electrode sets) is not limited to specific values. However, since an actually generated radio-frequency electric field is disordered at both (inlet and outlet) ends of the virtual rod electrodes, it is desirable to have a few or more plate electrodes arrayed along the ion beam axis C so as to create a stable radio-frequency electric field in which the aforementioned influence of the quadrupole electric-field component is reduced. The number of plate electrodes arranged in the x-y plane may not be four but any even number greater than four.

Figure 9:
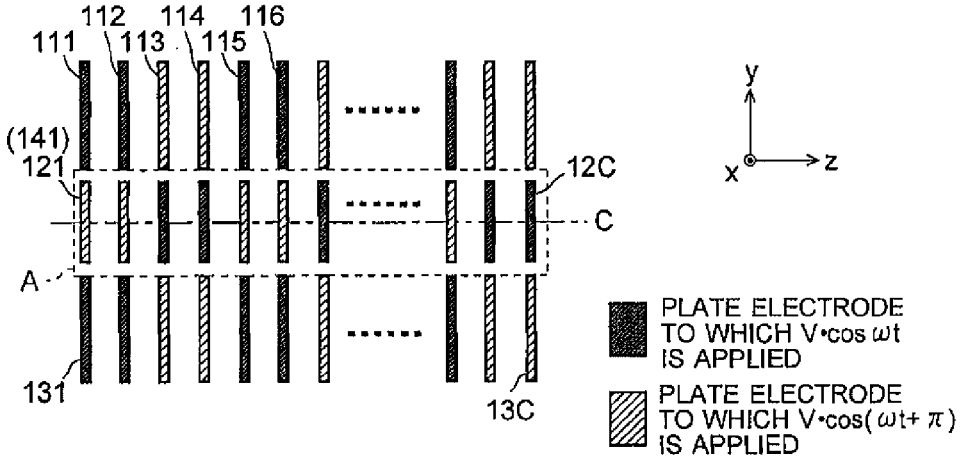
FIG. 9 is a diagram showing the plate electrode array of an ion optical element according to another mode of the present invention.

In the ion optical system of the previously described embodiment and the first half of the ion guide shown in the previous example, the phase of the radio-frequency voltage was inverted for every plate electrode along the ion beam axis C. However, it is also possible to invert the phase of the radio-frequency voltage for every two or more plate electrodes. An ion optical element according to one example of this case is shown in FIG. 9. FIG. 9 is a diagram showing a plate electrode array in a manner similar to FIG. 8.

In this example, radio-frequency voltages $V \cdot \cos \omega t$ and $V \cdot \cos(\omega t+\pi)$ are alternately applied for every two plate electrodes neighboring each other along the ion optical axis C. For example, in one virtual rod electrode, radio-frequency voltages $V \cdot \cos \omega t$ having the same phase are applied to the plate electrodes 111 and 112, while radio-frequency voltages $V \cdot \cos(\omega t+\pi)$ having a phase shift of 180 degrees are applied to the neighboring plate electrodes 113 and 114. This can be regarded as a system in which the phase inversion cycle of the radio-frequency voltage in the direction of the ion beam axis C is set larger than in the case of FIG. 2. When the phase inversion cycle is increased in this manner, the quadrupole component of the electric field becomes more dominant than in the case where the phase inversion cycle is small. Therefore, the phase inversion cycle, i.e. the number of mutually neighboring plate electrodes (or the number of electrode sets) to which radio-frequency voltages having the same phase are applied, can be appropriately adjusted according to the desired ion optical characteristics.

Of course, one can freely design the combination of phase inversion cycles in one virtual rod electrode. Therefore, it is possible to arrange any number of different phase inversion cycles in any order.

In International Patent Application No. PCT/JP2008/000043, the applicant of the present patent application proposed the idea of changing the thickness of the plate electrodes, the intervals between the electrodes neighboring each other, and other elements of the geometrical structure so as to relatively decrease the quadrupole component of the electric field and thereby increase higher-order multipole components. This technique can be combined with the present invention, in which case the ion optical characteristics can be adjusted even more flexibly and extensively.

Figure 10:
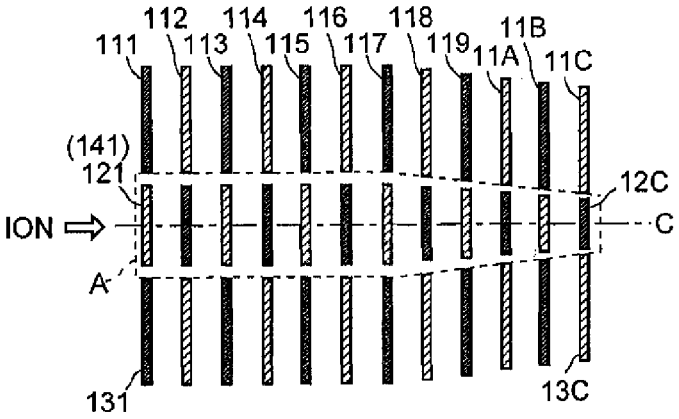
FIG. 10 is a diagram showing the plate electrode array of an ion optical element according to another mode of the present invention.

An ion optical element according to another example is shown in FIG. 10. In this ion optical element, the inscribed cylinder A, which is in contact with the plate electrodes, is shaped like a cone; that is to say, its diameter decreases in the moving direction of the ions. As already noted, when the ion optical system is configured as in the embodiment shown in FIG. 2, the ion convergence yielded by the potential profile is low. However, when the ion transport space itself is narrowed down as in the present example, the ions will be gathered into a narrow space around the ion beam axis C and efficiently transported through the passage hole 26 or the like.

Figure 11:
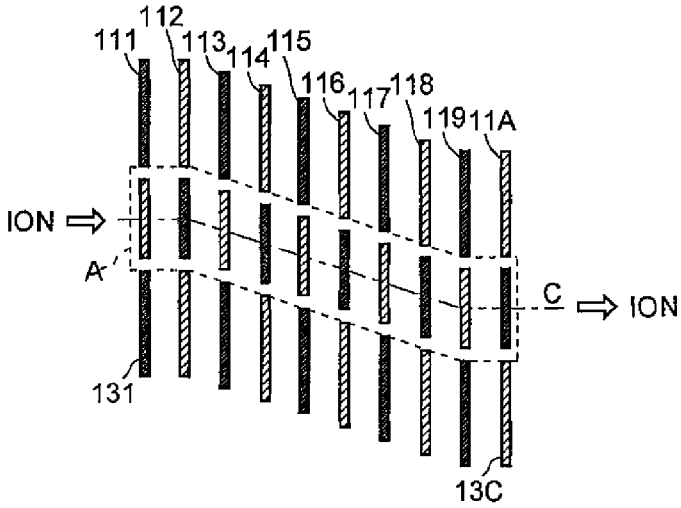
FIG. 11 is a diagram showing the plate electrode array of an ion optical element according to another mode of the present invention.
Figure 12:
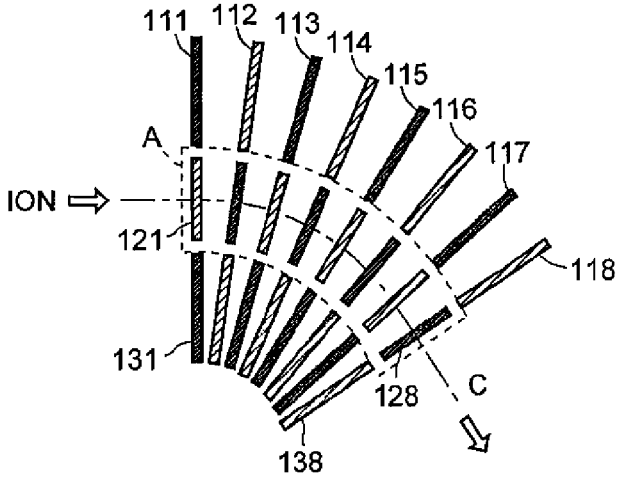
FIG. 12 is a diagram showing the plate electrode array of an ion optical element according to another mode of the present invention.

The plate electrodes can be arranged in many other forms. FIG. 11 shows a plate electrode arrangement structure in which the ion beam axes in the inlet and outlet sections are out of alignment with each other and yet parallel to each other. This design is often used for some special purposes, such as removing neutral particles that directly fly without being affected by the electric field. FIG. 12 shows a plate electrode arrangement structure in which the ion beam axes in the inlet and outlet sections are neither in alignment with each other nor parallel to each other. This design is often used, for example, for changing the moving direction of the ions. Naturally, these plate electrode arrangements can be modified in the previously described manners to introduce different phase inversion cycles or partially include the configuration of a conventional ion optical system.

Figure 13:
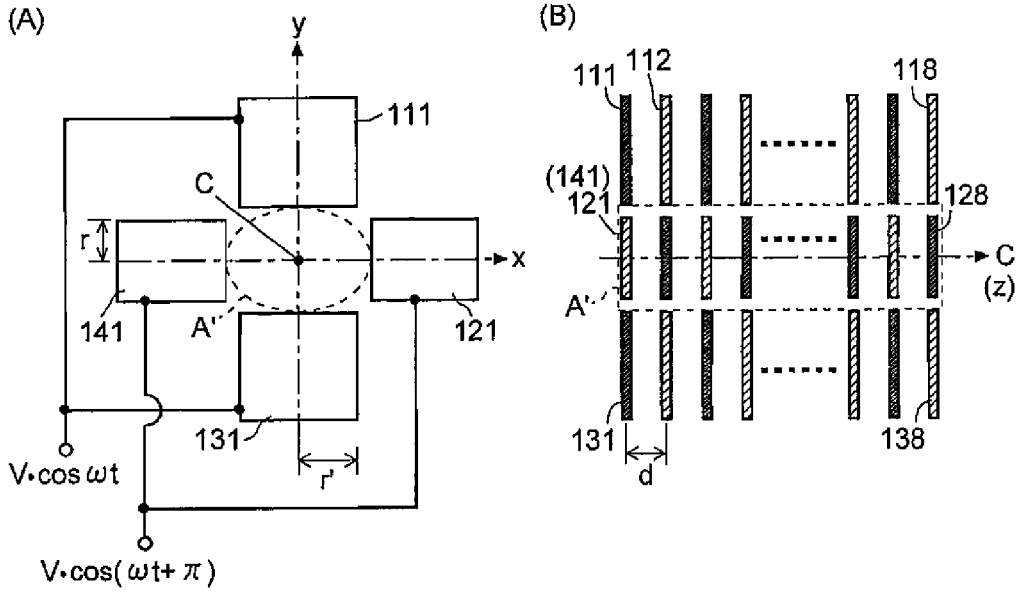
FIG. 13 is a diagram showing the plate electrode array of an ion optical element according to another mode of the present invention.

FIG. 13 shows a plate electrode arrangement structure in which the arrangement of four plate electrodes in an x-y plane is rotationally asymmetrical. The four plate electrodes 111, 121, 131 and 141 are in contact with an inscribed elliptic cylinder A' with its central axis lying on the ion beam axis C. The width r' of the plate electrodes 111 and 131 is larger than the width r of the other plate electrodes 121 and 141. When the rotation symmetry is broken as in this case, higher-order electric-field components that cannot be generated by a symmetrical configuration become noticeable. Specifically, in the structure of FIG. 13, an octapole component of the electric field prominently emerges. In this manner, the ion optical system according to the present invention can be applied in a plate-electrode structure that is rotationally asymmetrical with respect to the ion beam axis C.

Figure 14:
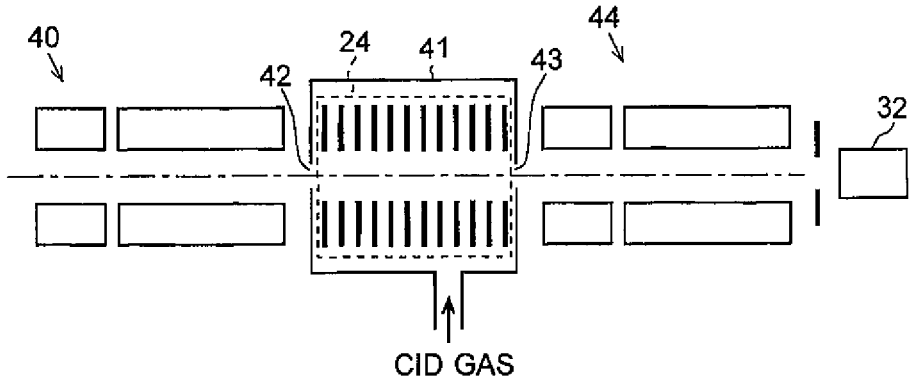
FIG. 14 is a configuration diagram showing the main components of a mass spectrometer which is another mode of the present invention.
Figure 15:
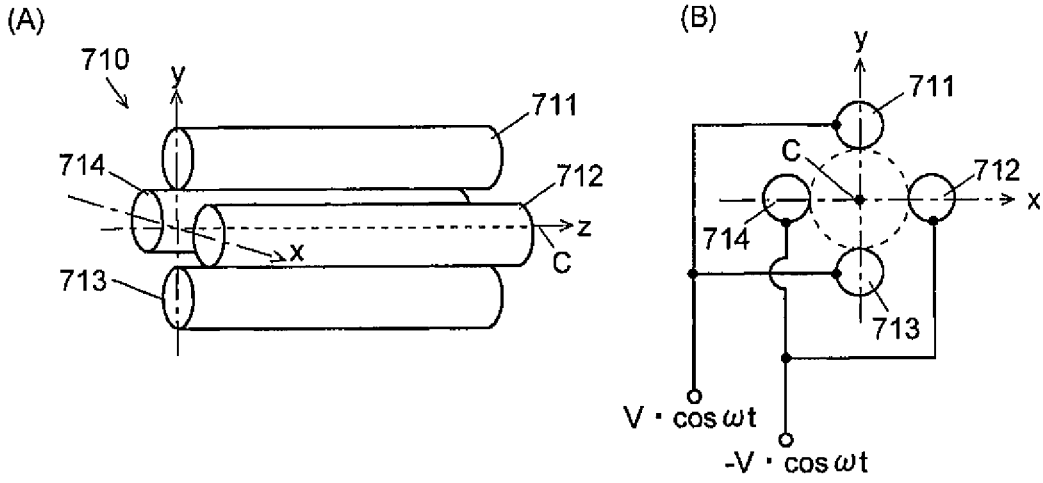
FIG. 15(A) is a schematic perspective view of a generally used conventional quadrupole rod ion guide.
FIG. 15(B) is a plan view in an x-y plane perpendicular to the ion beam axis C.
Figure 16:
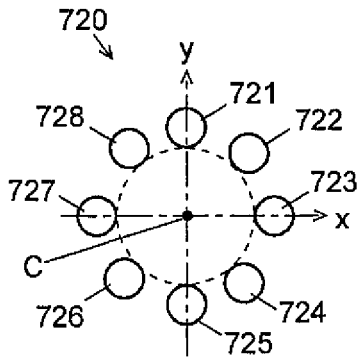
FIG. 16 is a plan view of a conventional octapole rod ion guide in an x-y plane perpendicular to its ion beam axis C.
Figure 17:
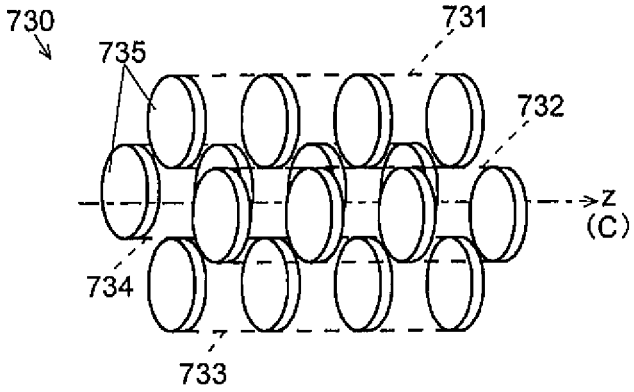
FIG. 17 is a schematic configuration diagram of an ion guide using conventional virtual rod electrodes.

The various modes of ion optical systems described thus far can be used not only in the first intermediate vacuum chamber of a mass spectrometer having an atmospheric pressure ionization interface but also in many other sections of a mass spectrometer. FIG. 14 is a configuration diagram showing the case where an ion optical system according to the present invention is used in an MS/MS mass spectrometer having a triple-stage quadrupole configuration. This figure shows only an analysis chamber 29, which maintains a high vacuum atmosphere in FIG. 7.

A first quadrupole mass filter 40, a collision cell 41 and a second quadrupole mass filter 44 are provided in the moving direction of the ions. An ion guide 24 having the same structure as that of the previously described first ion guide is provided inside the collision cell 41. Various kinds of ions having different mass-to-charge ratios m/z are introduced into the first quadrupole mass filter 40, among which only an objective ion (precursor ion) having a specific mass-to-charge ratio is selected to pass through the filter and enter the collision cell 41 in the next stage, while the other ions are dissipated halfway. A collision-induced dissociation (CID) gas, such as argon gas, is introduced into the collision cell 41. When passing through an electric field created by the ion guide 24, the precursor ion collides with the CID gas and is thereby dissociated, producing various kinds of product ions. These product ions, along with the precursor ions that have not been dissociated, exit the collision cell 41 and are introduced into the second quadrupole mass filter 44, in which only a product ion having a specific mass-to-charge ratio is selected to pass through the filter and be detected by the ion detector 32.

The inside of the analysis chamber is in a high vacuum state, whereas, inside the collision cell 41, a low vacuum state is locally created due to the CID gas supplied into it. To prevent a decrease in the degree of vacuum in the inner spaces of the quadrupole mass filters 40 and 44 before and after the collision cell, the ion injection hole 42 and the ion ejection hole 43 of the collision cell 41 are small sized. Therefore, similar to the case of FIG. 7, the ion guide provided inside the collision cell must simultaneously achieve both the high ion transmission/storage efficiency and high ion convergence under relatively low degrees of vacuum. To satisfy this requirement, the phase of the radio-frequency voltage is inverted for every plate electrode along the ion beam axis C in the first half 241 close to the ion injection hole 42, as in FIG. 8, so as to attain a high ion transmission/storage efficiency for a wide mass range of ions. Simultaneously, in the second half 242 close to the ion ejection hole 43, an ion optical system similar to the conventional one is used to improve the ion convergence so as to avoid the loss of ions at the small-sized ion ejection hole 43.

As already noted, the ion optical characteristics of the present system can be adjusted with considerable flexibility and extensiveness by controlling the phase inversion cycle or combining it with a conventional ion optical system. Therefore, the present system can be utilized in various forms other than the aforementioned ones; for example, it can also be substituted for the pre-rod electrodes of a quadrupole mass filter.

It should be noted that the previously described examples are mere examples of the present invention, and any change, modification or addition appropriately made within the spirit of the present invention will be naturally included in the scope of claims of the present patent application.

The invention claimed is:

1. A mass spectrometer having an ion optical system for transporting ions to a next stage, which is characterized in that the ion optical system includes:

a) a virtual multipole rod ion optical element having 2×N pieces of virtual rod electrodes where N is an integer equal to or greater than two, arranged so as to surround an ion beam axis, each virtual rod electrode being composed of M pieces of plate electrodes spaced along the ion beam axis where M is an integer equal to or greater than three; and b) a voltage-applying means for applying radio-frequency voltages in a following manner: in each set of the 2×N plate electrodes arranged around the ion beam axis, a same radio-frequency voltage is applied to any two plate electrodes opposing each other across the ion beam axis, and two radio-frequency voltages having a same amplitude and a phase difference of 180 degrees are respectively applied to any two plate electrodes neighboring each other around the ion beam axis; and in each set of the M plate electrodes forming one virtual rod electrode, a phase of the radio-frequency voltage applied to at least one of the plate electrodes is different from a phase of the radio-frequency voltage applied to another plate electrode.

2. The mass spectrometer according to claim 1, which is characterized in that the voltage-applying means applies a radio-frequency voltage having a same amplitude as that of the radio-frequency voltage applied to another plate electrode and a phase difference of 180 degrees, to at least one of the M pieces of the plate electrodes forming each virtual rod electrode.

3. The mass spectrometer according to claim 2, which is characterized in that radio-frequency voltages having a phase difference of 180 degrees are alternately applied for every group consisting of one or more of the plate electrodes neighboring each other along the ion beam axis at least in a part of the M-piece plate electrodes forming each virtual rod electrode.

4. The mass spectrometer according to claim 3, which is characterized in that the M pieces of the plate electrodes forming each virtual rod electrode include an electrode group in which the radio-frequency voltages having a phase difference of 180 degrees is alternately applied for every first number of plate electrodes neighboring each other along the ion beam axis, and another electrode group in which the radio-frequency voltages having a phase difference of 180 degrees is alternately applied for every second number of plate electrodes neighboring each other along the ion beam axis, where the second number differs from the first number.

5. The mass spectrometer according to claim 4, which is characterized in that N is 2.

6. The mass spectrometer according to claim 3, which is characterized in that that the M pieces of the plate electrodes forming each virtual rod electrode include an electrode group in which the radio-frequency voltages having a phase difference of 180 degrees are alternately applied for every predetermined number of plate electrodes neighboring each other along the ion beam axis, and another electrode group in which the same radio-frequency voltage is applied.

7. The mass spectrometer according to claim 6, which is characterized in that N is 2.

8. The mass spectrometer according to claim 6, which is characterized in that: the voltage-applying means is configured so that the radio-frequency voltages having a phase difference of 180 degrees are alternately applied for each of the plate electrodes neighboring each other along the ion beam axis at least in a part of the M-piece plate electrodes forming each virtual rod electrode; and M is equal to or greater than four.

9. The mass spectrometer according to claim 8, which is characterized by comprising an ion source for ionizing a sample component under approximately atmospheric pressure and a mass separator for separately detecting ions according to their mass under high vacuum, with one or more intermediate vacuum chambers provided between the ion source and the mass separator, the ion source communicating with the intermediate vacuum chamber next to it via either a small ion-passage hole or a thin ion-passage pipe, and the ion optical system being placed within this intermediate vacuum chamber.

10. The mass spectrometer according to claim 8, which is characterized by comprising a collision chamber placed under a high vacuum atmosphere, the collision chamber being used for dissociating an ion by bringing the ion into collision with a collision-induced dissociation gas supplied into the collision chamber, and the ion optical system being placed within this collision chamber.

11. The mass spectrometer according to claim 3, which is characterized in that N is 2.

12. The mass spectrometer according to claim 3, which is characterized in that: the voltage-applying means is configured so that the radio-frequency voltages having a phase difference of 180 degrees are alternately applied for each of the plate electrodes neighboring each other along the ion beam axis at least in a part of the M-piece plate electrodes forming each virtual rod electrode; and M is equal to or greater than four.

13. The mass spectrometer according to claim 12, which is characterized by comprising an ion source for ionizing a sample component under approximately atmospheric pressure and a mass separator for separately detecting ions according to their mass under high vacuum, with one or more intermediate vacuum chambers provided between the ion source and the mass separator, the ion source communicating with the intermediate vacuum chamber next to it via either a small ion-passage hole or a thin ion-passage pipe, and the ion optical system being placed within this intermediate vacuum chamber.

14. The mass spectrometer according to claim 12, which is characterized by comprising a collision chamber placed under a high vacuum atmosphere, the collision chamber being used for dissociating an ion by bringing the ion into collision with a collision-induced dissociation gas supplied into the collision chamber, and the ion optical system being placed within this collision chamber.

15. A mass spectrometer comprising:

an ion optical element having four or more even number of virtual rod electrodes, symmetrically arranged about and along an ion beam axis, each virtual rod electrode comprising three or more plate electrodes disposed in parallel to each other and spaced along the ion beam axis; and a voltage generator for applying radio-frequency voltages to each pair of plate electrodes within a plane perpendicular to the ion beam axis, the pair opposing each other across the ion beam axis and residing respectively in a pair of virtual rod electrodes symmetrically disposed about the ion beam axis, wherein, for the plate electrodes within a plane perpendicular to the ion beam axis, a same radio-frequency voltage with a first phase is applied to one pair of plate electrodes opposing each other across the ion beam axis, and a same radio-frequency voltage with a second phase with a 180 degree phrase difference from the first phase is applied to another pair of plate electrodes opposing each other across the ion beam axis and neighboring the previous one pair such that any neighboring pairs of plate electrodes within the same plane have the same radio-frequency voltage but with a 180 degree phase difference; and wherein, within each virtual rod electrode with the plate electrodes disposed along the ion beam axis, a phase of the radio-frequency voltage applied to at least one of the plate electrodes is different from a phase of the radio-frequency voltage applied to another plate electrode.

16. The mass spectrometer according to claim 15, wherein, within each virtual rod electrode with the plate electrodes, the voltage generator applies to one plate electrode a radio-frequency voltage having a same amplitude as that of the radio-frequency voltage applied to another plate electrode but with a phase difference of 180 degrees.

17. The mass spectrometer according to claim 16, wherein, for at least a group of the plate electrodes within each virtual rod electrode, the radio-frequency voltages having a phase difference of 180 degrees are alternately applied to the plate electrodes neighboring each other along the ion beam axis.

18. The mass spectrometer according to claim 17, wherein, within each virtual rod electrode, for a first set of plate electrodes, the radio-frequency voltages having a phase difference of 180 degrees is alternately applied for every first number of plate electrodes neighboring each other along the ion beam axis; and for a second set of plate electrodes, the radio-frequency voltages having a phase difference of 180 degrees is alternately applied for every second number of plate electrodes neighboring each other along the ion beam axis, where the second number differs from the first number.

19. The mass spectrometer according to claim 17, wherein within each virtual rod electrode, for a first set of plate electrodes, the radio-frequency voltages having a phase difference of 180 degrees are alternately applied for every predetermined number of plate electrodes neighboring each other along the ion beam axis; and for a second set of plate electrodes, the same radio-frequency voltage is applied.

20. The mass spectrometer according to claim 17, wherein the voltage generator is configured so that the radio-frequency voltages having a phase difference of 180 degrees are alternately applied for each of the plate electrodes neighboring each other along the ion beam axis at least in a part of the four or more plate electrodes within each virtual rod electrode.

* * * * *